United States Patent [19]

Badiali

[11] 4,456,289

[45] Jun. 26, 1984

[54] ADD-ON LOCKING MECHANISM FOR A VEHICLE HOOD

[75] Inventor: John A. Badiali, Brockton, Mass.

[73] Assignee: Metra Electronics Corporation, Brooklyn, N.Y.

[21] Appl. No.: 430,725

[22] Filed: Sep. 30, 1982

[51] Int. Cl.[3] ..... E05C 3/30; E05C 9/00

[52] U.S. Cl. ..... 292/28; 292/50; 292/DIG. 14; 292/125

[58] Field of Search ..... 292/28, 50, 84, 110, 292/125, 133, 96, 171, 141, 225, 235, DIG. 14; 70/162, 240, 241; 74/501

[56] References Cited

U.S. PATENT DOCUMENTS

| | | | |
|---|---|---|---|
| Re. 16,945 | 4/1928 | Knight . | |
| 1,481,498 | 1/1924 | Boggess | 70/241 |
| 1,692,295 | 11/1928 | Gerard | 292/DIG. 14 X |
| 1,713,645 | 5/1929 | Dayton | 70/241 |
| 1,725,158 | 8/1929 | Pinkerton | 70/241 |
| 1,733,128 | 10/1929 | Mauborgne | 70/240 |
| 1,825,413 | 9/1931 | Norviel | 70/241 |
| 2,274,696 | 3/1942 | Hill et al. | 292/225 |
| 2,329,348 | 9/1943 | Honig | 292/125 |
| 2,548,242 | 4/1951 | Rosenbarger | 292/171 |
| 2,693,381 | 11/1954 | Butler | 292/117 |
| 2,756,085 | 7/1956 | Hochstadt | 292/210 |
| 2,809,064 | 10/1957 | Dlugatch | 292/226 |
| 3,199,322 | 8/1965 | Braun et al. | 70/240 |
| 3,347,071 | 10/1967 | Solow | 70/240 |
| 3,529,452 | 9/1970 | Rae | 70/240 |
| 3,546,962 | 12/1970 | Ruhala | 74/501 |
| 3,572,790 | 3/1971 | Kapanka | 292/125 |
| 3,668,908 | 6/1972 | Levy | 70/240 |
| 4,099,593 | 7/1978 | Schultz | 70/241 X |
| 4,102,164 | 7/1978 | Barbush | 70/241 |

FOREIGN PATENT DOCUMENTS

| | | | |
|---|---|---|---|
| 702364 | 1/1954 | United Kingdom | 292/171 |

*Primary Examiner*—Thomas J. Holko

*Attorney, Agent, or Firm*—Kirschstein, Kirschstein, Ottinger & Israel

[57] ABSTRACT

An add-on locking mechanism for a vehicle hood is provided in addition to a standard hood locking arrangement. The locking mechanism includes a mounting plate which is mounted on a support plate of the locking arrangement, and a locking latch that is pivotally mounted on the mounting plate. The locking latch engages and disengages a hasp which is mounted on the hood and with which a pivotable catch of the locking arrangement also cooperates. The locking latch is operated by a Bowden cable which is connected to a key-operated lock situated in the passenger compartment of the vehicle. The cable core of the Bowden cable is connected to the locking latch, while the jacket is mounted on a mounting bracket that is mounted on the mounting plate. The position of the mounting bracket on the mounting plate is adjustable, in that the mounting bracket is provided with an elongated slot through which there passes a threaded pin rigid with the mounting plate, and in that a nut is threaded onto the threaded pin and frictionally engages the mounting bracket around the slot upon tightening to hold the mounting bracket in position. The mounting bracket further has a lug which extends into and is guided in an elongated slot of the mounting plate. A lug of the locking latch passes through and engages behind an opening of an operating bracket that is secured to the cable core.

15 Claims, 4 Drawing Figures

ADD-ON LOCKING MECHANISM FOR A VEHICLE HOOD

BACKGROUND OF THE INVENTION

The present invention relates to locking mechanisms in general, and more particularly to a locking mechanism for locking a vehicle hood in its closed position.

Since the advent of the automobile, attempts have been made by persons other than the owner or authorized users to gain access to or possession of the same, either to joyride or to steal the automobile or parts thereof for financial gain. This problem was recognized quite soon after the development of the first automobile, and the manufacturers have attempted to make such unauthorized activity as difficult as possible, if not impossible. So, for instance, it is customary nowadays not only to provide the doors of the car or similar motor vehicle with locks, but also to make the ignition operatable only by a key. Moreover, many cars are provided with burglar alarms to alert the owner or anyone close enough to perceive the alarm of any unlawful or unauthorized entry into the car. However, as the sophistication of such protective devices grew, so did the dexterity and ingenuity of car thieves, while burglary tools became better suited for the intended purposes, so that there is hardly any car on the road which a skilled car theif could not enter and drive away, given sufficient time to accomplish this task. Since it is almost impossible to make a car totally burglar-proof, and since it may even be desirable to keep the possibility of entering the car without the proper set of keys open, for instance, when the owner loses the keys, or when a law enforcement officer, a fireman or another person in a similar position has to enter the car in the absence of the owner or user, such as in the event of an emergency, to discontinue the operation of a malfunctioning burglar alarm or the like, the car manufacturing industry limits itself to installing only such protective devices which will make it very time-consuming to gain access to the car or into the various compartments thereof, but not impossible. The aftermarket manufacturers of protective devices are guided by similar considerations.

Most of the passenger cars currently on the market are provided with a locking or latching arrangement for the vehicle hood which can be partially or fully opened or released by operating a release lever or a similar release actuator situated in the passenger compartment of the car. Thus, a person who has gained access to the passenger compartment, either because the owner forgot to lock the door or after picking the lock or otherwise opening the door locking mechanism, can also rather easily gain access to the motor compartment situated under the hood. Thus, if a burglar alarm is situated in the motor compartment, such a person can discontinue the operation of the same, for instance, by cutting the electric wires supplying electric current thereto. Such a person can also "hotwire" the car, that is, bypass the key-operated ignition switch, and drive away. Also, certain parts, such as the battery or the like, can be stolen from the engine compartment or replaced by lesser quality parts, for instance, in parking garages or parking lots while the owner or authorized user is absent, either by dishonest attendants or by other patrons or persons entering the premises and entering the passenger compartment through an unlocked door while the car is otherwise unattended.

To avoid such possibilities, there have been developed locking or latching arrangements for the vehicle hood of various degrees of complexity. So, for instance, the U.S. Pat. No. 4,099,593 discloses an automobile lock mechanism including a key-operated, cable-displaced cam lock that selectively prevents actuation of the regular hood release mechanism by immobilizing the release cable. The U.S. Pat. No. 3,347,071 illustrates and describes another construction of automobile hood locking mechanism which includes a key-operated latching element coacting with a slotted lever forming a part of the hood latching mechanism for releasably holding the slotted lever against movement. Another latching device for an automobile hood is revealed in U.S. Pat. No. 3,199,322 wherein the latching device is key-operated and is operative for preventing movement of the regular hood latching mechanism. The hood latching device of the U.S. Pat. No. 2,809,064 is cable-operated and is to be used for preventing conventional hood release mechanism actuation. Finally, U.S. Pat. No. 2,756,085 discloses a barrier device for automobile hood locks, wherein the barrier device includes a secondary latch that holds the main hood latch against release until the barrier device is removed by a pull on a flexible cable. Other hood locking devices are shown in U.S. Pat. Nos. 4,102,164, 3,668,908, 1,733,128, 2,693,381, U.S. Pat. No. Re. 16,945, U.S. Pat. Nos. 1,725,158, 1,825,413, 1,481,498 and 1,713,645.

Most if not all of the above-mentioned arrangements are factory-installed and quite incapable of modification so that the expedients used therein can be utilized only if the car has such an arrangement as a part of the original equipment, or upon extensive modification, including replacing the original locking or latching arrangement in its entirety by the new one. To avoid such extensive rebuilding, it was proposed to provide an add-on locking mechanism including an L-shaped locking bracket which has one arm mounted on the underside of the hood by conventional metal screws, and a downwardly extending arm, as well as a slidable piston assembly which is mounted below the locking bracket. The piston assembly includes a slidable piston which is movable between a locking position in which it is received in an oversized hole or slot of the downwardly extending slot, and a retracted position in which the piston is remote from the hole of slot. The piston is movable between its locking and retracted positions by a cable whose end remote from the piston is situated in the passenger compartment of the motor vehicle. In contrast to the conventional hood locking arrangement cable which is connected to a lever or a similar freely actuatable element, the actuating, end of the cable of this add-on locking mechanism is connected to a key-operated lock, such as a Chapman lock. The cable is acutated to move the piston into or out of the oversized hole of the locking bracket by turning the proper key in the lock. The oversized configuration of the hole is necessary in order to assure that the piston will be able to enter the same, regardless of inaccuracies of mounting of the locking bracket and of the piston mechanism, which are unavoidable when the locking mechanism is mounted as an add-on equipment, regardless of the care taken.

Now, many hood holding or locking arrangements are so constructed, especially when the hood opens in front, that the hood release mechanism will permit the hood to open only partially in response to the operation of the hood release lever or the like, so that a gap of a predetermined relatively small width will be formed between the hood and the vehicle body. Then, a safety mechanism which may be accessed through this gap has to be operated before the hood can be fully opened. Because of the oversized configuration of the hole in the locking lever, the add-on or redundant locking mechanism will not interfere with the formation of this gap upon actuation of the release lever, even if the piston is still in its locking position. Thus, an intruder who has gained access to the hood release lever by entering the passenger compartment may operate the hood release lever and then insert a crowbar or a similar lever into the gap and pry the hood open, or render the add-on locking mechanism inoperative, for instance, by deforming the locking bracket through the gap out of the way of the locking piston. This, of course, is very disadvantageous.

SUMMARY OF THE INVENTION

Accordingly, it is a general object of the present invention to avoid the disadvantages of the prior art.

More particularly, it is an object of the present invention to provide a key-operated locking mechanism for use in locking a motor vehicle hood in its closed position, which locking mechanism does not possess the disadvantages of the conventional locking arrangements of this type.

Still another object of the present invention is to so construct the locking mechanism as to be capable of use not only as a part of the factory-installed locking arrangement, but also as a supplemental equipment.

It is yet another object of the present invention to develop a locking mechanism of the type here under consideration which holds the vehicle hood in its fully closed position even upon release of the conventional locking arrangement so as to prevent tampering therewith or with the locking arrangement.

A concomitant object of the present invention is so to design the locking mechanism of the above type as to be simple in construction, easy to install, inexpensive to manufacture, easy to use by authorized and difficult to tamper with by unauthorized persons, and reliable in operation nevertheless.

In pursuance of these objects and others which will become apparent hereafter, one feature of the present invention resides in an add-on locking mechanism for use in conjunction with a conventional motor vehicle hood locking arrangement that includes a hasp secured to the vehicle hood, a support plate stationarily mounted on the vehicle body, and a cable-released catch mounted on the support plate for pivoting and engageable with the hasp for holding the hood in its closed position until released, this locking mechanism comprising a locking latch having a mounting portion and a substantially hook-shaped locking portion rigid with and extending along a predetermined course from the mounting portion; means for so mounting the mounting portion of the locking latch on the support plate for pivoting between a locking and an unlocking position that the locking portion extends through the hasp and engages the same in the locking position to thereby prevent movement of the hood out of its closed position regardless of the position of the catch, and is removed from the hasp in the unlocking position; and means for operating the locking latch, including a key-operated lock mounted on the vehicle body and movable between a locked and an unlocked position, a removable key operative for moving the lock between the locked and unlocked positions, and a connecting cable connecting the lock with the locking latch and operative for pivoting the latter between its locking and unlocking positions in reponse to the movement of the lock between its locked and unlocked positions.

A particular advantage of this construction is that, since the locking mechanism is provided with a lock, it cannot be operated by unauthorized persons, be they intruders or persons, such as garage or parking lot attendants who are permitted access to the passenger compartment of the car but have no business opening the motor compartment hood. Moreover, since the locking mechanism is provided in addition to the conventional hood locking arrangement, it provides an additional measure of protection against prying open the hood. More particularly, since the inventive hood locking mechanism keeps the hood in its closed position even after the actuation of the release lever or similar acutating element of the hood locking arrangement, mere access to the release handle or lever and actuation thereof will not permit an intruder to open the hood, even forcibly by applying a crowbar, since the locking portion of the locking latch will maintain the hood in its closed position by engaging the hasp.

This aspect of the present invention is particularly pronounced when, in accordance with the present invention, the locking portion of the locking latch is provided with an engagement surface facing toward and centered on the axis of pivoting of the locking latch so as to engage the hasp not only when the locking latch is in its locking position, but also when it pivots between its locking and unlocking positions. By using this expedient, it is assured that no gap will be formed between the hood and the vehicle body until the locking latch has moved all the way into its unlocking position.

A particularly advantageous construction of the locking mechanism of the present invention is obtained when the connecting cable is constructed as a Bowden cable having a tubular jacket and a cable core received in the jacket for axial movement therein. Under these circumstances, the cable can extend along such a course as desired or as dictated by the available space or other considerations, without sacrificing or impairing the function of the cable.

A particularly simple construction of the locking mechanism according to the present invention, which is particularly useful when the locking mechanism is to be installed as additional equipment to supplement the factory-installed conventional locking arrangement, is obtained when, in accordance with an additional facet of the present invention, the mounting means includes a mounting plate connected to the support plate of the locking arrangement and a mounting bracket secured to the mounting plate and connected to the jacket of the connecting cable. In this construction, it is very simple to mount the mounting plate on the support plate, using existing or additional screws or similar fasteners, without requiring an extensive modification of the locking arrangement.

According to an additional concept of the present invention, the mounting means further includes means for securing the mounting bracket to the mounting plate for positional adjustment relative thereto, such adjustable securing means including an elongated slot in the mounting bracket, and at least one threaded connection extending through the slot, the threaded connection including meshing external and internal threads and having two parts one of which is rigid with the mounting plate and the other of which frictionally engages the mounting bracket around the slot to hold the mounting bracket in the selected position thereof relative to the mounting plate upon tightening of the threaded connection. The threaded connection may include, for instance, a screw having a stem provided with the external thread and a head constituting the other part, while the one part of the threaded connection is a portion of the mounting plate provided with an internally threaded bore. However, the threaded connection could also include an externally threaded portion extending through a bore of, or integral with, the mounting plate and passing through the slot of the mounting bracket to constitute the one part of the threaded connection, while the other part is constituted by an internally threaded nut threaded onto the threaded portion. This expedient renders it possible to accurately mount the locking latch relatively to the support plate and thus to the catch and the hasp, without having to resort to any material-removing operations. Obviously, the provision of the mounting plate, on which the locking latch is pivotally mounted, renders it possible to supply the locking mechanism as an assembled kit which can be easily installed even by people with limited manual skills.

The novel features which are considered as characteristic of the invention are set forth in particular in the appended claims. The improved add-on locking mechanism itself, however, both as to its construction and its mode of operation, together with additional features and advantages thereof, will be best understood upon perusal of the following detailed description of a specific embodiment thereof with reference to the accompanying drawing.

DETAILED DESCRIPTION OF THE PREFERRED EMBODIMENT

Figure 1:
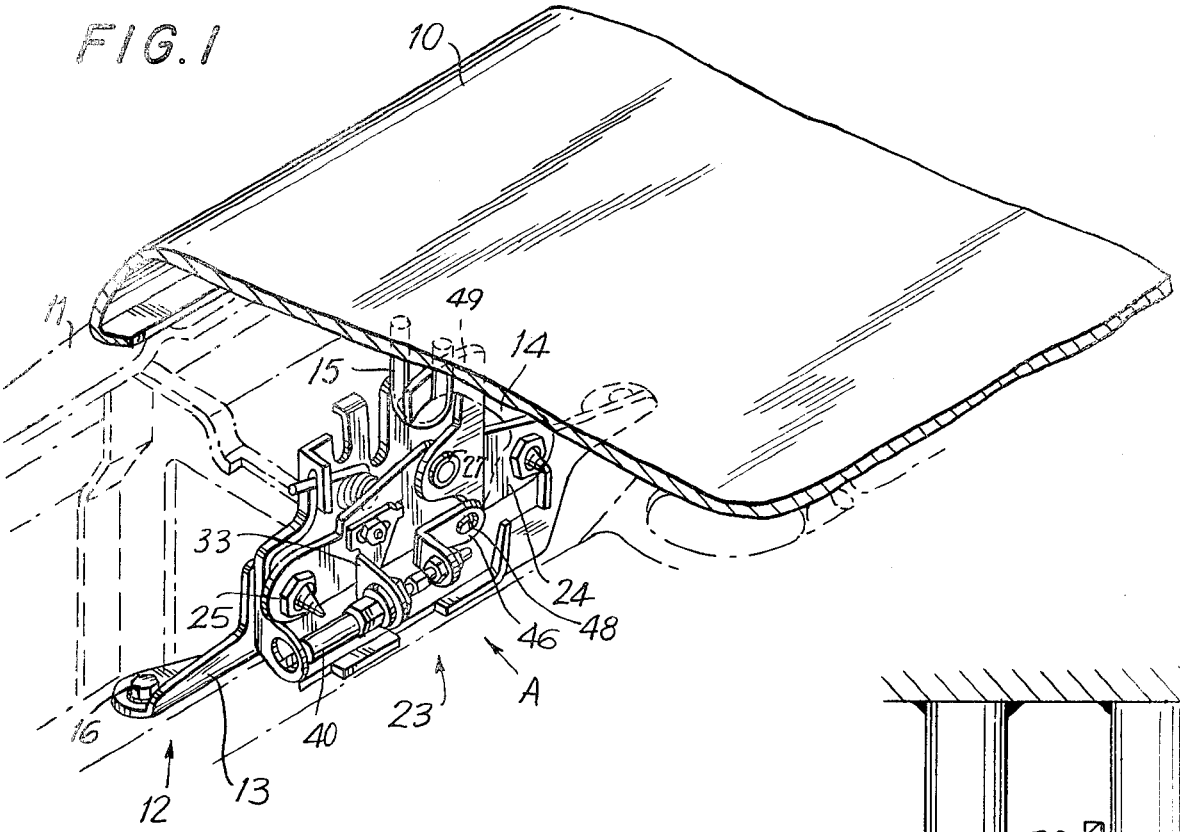
FIG. 1 is a perspective view of a locking arrangement for a motor vehicle hood provided with a locking mechanism according to the present invention.

Referring now to the drawing in detail, and first to FIG. 1 thereof, it may be seen that the reference numeral 10 has been used therein to identify a vehicle hood, while the reference numeral 11 denotes a car body which is indicated only in phantom lines. A locking arrangement, designated in its entirety by the reference numeral 12, is stationarily mounted on the car body 11 and includes, as its main components, a support plate 13 and a locking catch 14. The locking catch 14 cooperates with a hasp 15 that is secured to the hood 10. As already mentioned before, the construction of the locking arrangement 12 is conventional, so that it need be discussed herein only to the extent necessary for understanding the present invention.

Figure 2:
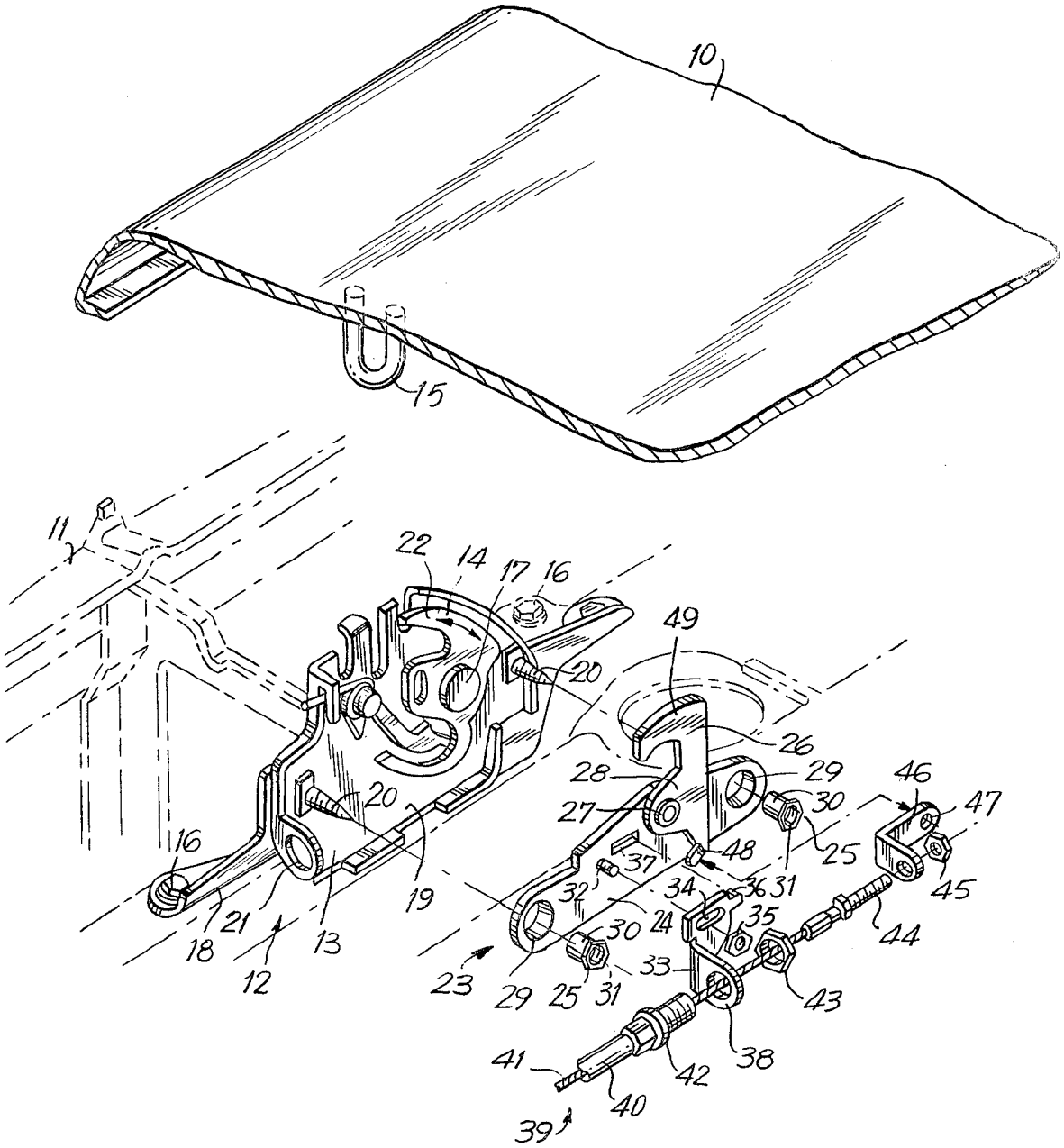
FIG. 2 is an exploded view of the locking mechanism and the associated parts in a perspective view akin to that of FIG. 1.

As comparison of FIGS. 1 and 2 with one another will reveal, the support plate 13 is mounted on the vehicle body 11 by screws 16. A pivot 17 mounts the locking catch 14 on the support plate 13 for pivoting. As illustrated, the support plate has a first part 18 which is secured by the screws 16 to the vehicle body 11, and a second part 19 which is secured to the first part 18 by screws 20. As shown in FIG. 2, the screws 20 extend beyond the second part 19. The locking catch 14 is pivoted between its positions in a conventional manner, the parts achieving such pivoting having been omitted from the drawing in order not to unnecessarily encumber the same. However, it is to be mentioned that the locking catch 14 is usually cable-released, and an eyelet 21 is provided on the second part 19 for the purpose of attaching or supporting the end of the cable.

As mentioned before, the locking catch 14 cooperates with the hasp 15 to keep the hood 10 in its closed position until released. To this end, the locking latch 14 has a hook-shaped engaging portion 22 which, starting from the position shown in FIG. 2, penetrates into the hasp 15 during the pivoting of the locking catch 14 in the counterclockwise direction, to engage behind the hasp 15.

Now, according to the present invention, the locking arrangement 12 is additionally provided with a locking mechanism 23 which is mounted on the support plate 13. As shown particularly in FIG. 2, the locking mechanism 23 includes a mounting plate 24 that is secured to the support plate 13 by means of the screws 20 and nuts 25 threaded onto the screws 20. A locking latch 26 is mounted on the mounting plate 24 for pivoting relative thereto, by a pivot 27 which penetrates through a mounting portion 28 of the locking latch 26 and connects the latter to the mounting plate 24 for the aforementioned pivoting. The locking latch 14 also cooperates with the hasp 15, in a manner yet to be described.

The mounting plate 24 has two holes 29 passing therethrough. Each of the nuts 25 has a hollow stem 30 which is received in the respective hole 29 and is internally threaded to engage the respective screw 20, and a head 31 having outer dimensions exceeding the diameter of the respective hole 29 to engage the mounting plate 24 around the respective hole 29. The mounting plate 24 further carries an externally threaded pin 32.

A mounting bracket 33 of the locking mechanism 23 is mounted on the mounting plate 24. To this end, the mounting bracket 33 is provided with an elongated slot 34 which receives the externally threaded pin 32 such that the latter extends beyond the mounting bracket 33 in the assembled condition. An internally threaded nut 35 is threaded onto the pin 32 in the assembled condition, and is tightened to frictionally engage the mounting bracket 33 around the slot 34 and thus to hold the mounting bracket 33 in the selected adjusted position thereof relative to the mounting plate 24. Of course, upon loosening of the nut 35, the position of the pin 32 in the elongated slot 34 can be changed and thus the relative position of the mounting bracket 33 can be adjusted. The mounting bracket 33 further includes a stamped-out projection or lug 36 which is received and guided in an elongated slot 37 of the mounting plate 24. This engagement prevents turning of the mounting bracket 33 about the pin 32. The mounting bracket 33 also has an eyelet portion 38.

The locking latch 26 is pivoted by means of a connecting cable 39 which is shown to be constituted by a Bowden cable including a cable jacket 40 and a cable core or wire 41. The end of the connecting cable jacket 40 carries an externally threaded connecting fitting 42 which is partially received in and extends beyond the eyelet portion 38. A nut 43 is threaded onto the connecting fitting 42 to hold the same in position relative to the eyelet portion 38 of the mounting bracket 33. So, for instance, the eyelet portion 38 may have an internal thread meshing with the external thread of the fitting 42 and the latter is turnable about the longitudinal axis of the cable 39 relative to the jacket 40. Then, the nut 43 serves as a locking nut.

The end of the cable core 41 has a threaded end piece 44 secured thereto, here again with the possibility of relative turning between the end piece 44 and the cable core 41. A nut 45 is threaded onto the end piece 44 to adjustably secure the same to an operating bracket 46 of an L-shaped configuration. The operating bracket 46 has an opening 47 which receives a stamped-out lug 48 of the locking lever 26 in a manner and for a purpose which will be discussed later.

Figure 3:
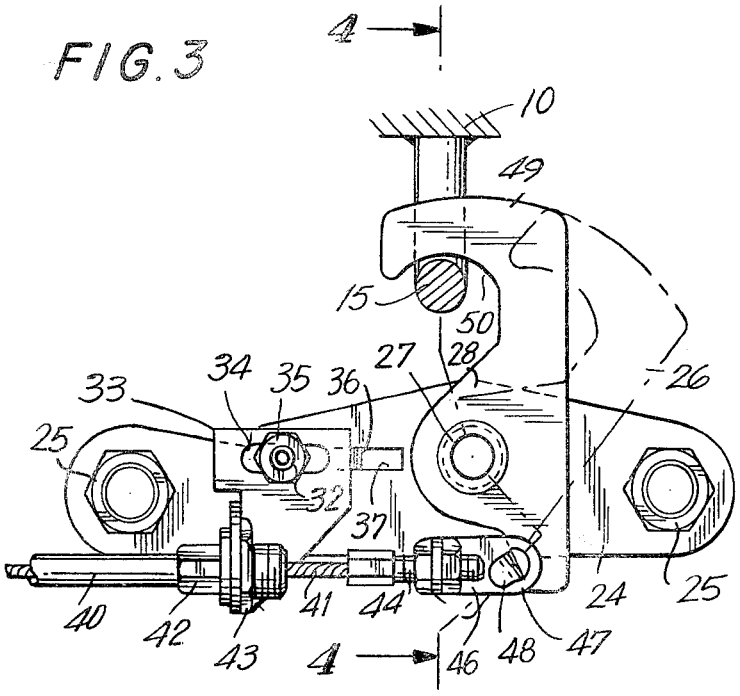
FIG. 3 is an axial view of the locking mechanism taken in the direction of the arrow A of FIG. 1.

As shown in FIG. 3, the locking latch 26 is pivotable about the pivot 27 between a locking position shown in solid lines, and an unlocking position shown in phantom lines. In the locking position, an engagement surface 50 of a hook-shaped locking portion 49 of the locking latch 26 is close to or engages the hasp 15 to thereby hold the hood 10 in position regardless of the state of the locking arrangement 12. Advantageously, the engagement surface 50 is substantially centered on the axis of the pivot 27 so that the engagement surface 50 engages the hasp 15 not only in the illustrated locking position, but also while it is displaced from this locking position in the clockwise or counterclockwise direction within a predetermined range.

Figure 4:
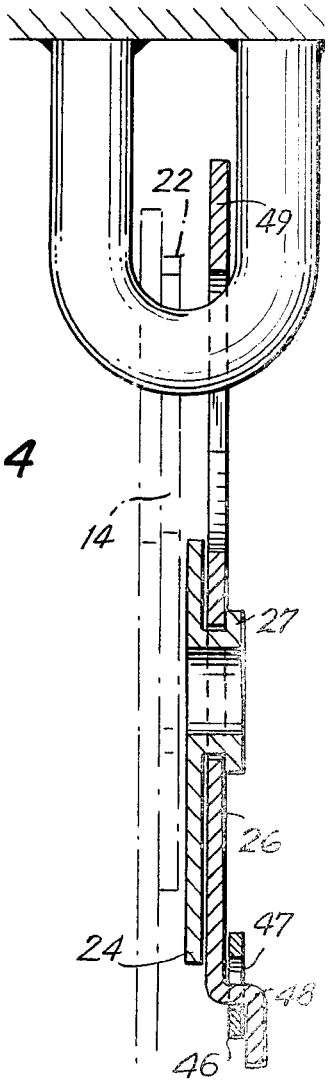
FIG. 4 is a cross-sectional view taken along the line 4—4 of FIG. 3.

As shown in FIG. 4, the locking catch 14 of the locking arrangement 12 is arranged substantially along the central plane of the hasp 15, leaving a certain amount of space free next to it whithin the area delimited by the hasp 15. The locking portion 49 of the locking latch 26 penetrates into this free space. FIG. 4 also shows that the pivot 27 is constituted by a stamped-out and upset portion of the mounting plate 24, and that the lug 48 of the locking latch 26 penetrates through the opening 47 of the operating bracket 46 and engages behind the same, thus connecting the operating bracket 46 to the locking latch 26 for joint movement therewith about the axis of the pivot 27.

Having so described the construction of the locking mechanism 23 of the present invention, the operation thereof and its cooperation with the hasp 15 and with the locking arrangement 12 will now be explained.

As mentioned before, the other end of the operating cable 39 is connected to a key-operated lock which is mounted on the vehicle body 11 in such a manner as to be accessible with the hood 10 in its closed position, for instance, from the passenger compartment. Since the lock is of a conventional construction, it has been omitted from the drawing. Suffice it to say that it is operated by a removable key in such a manner that the movement thereof into its unlocked position, for instance, by turning the key, will result in retraction of the cable core 41 into the cable jacket 40 at the illustrated end of the cable 39, and in opposite displacement of the cable core 41 relative to the cable jacket in response to the movement of the lock into its locking position. Now, because the end portion of the cable core 41 is connected by the end piece 44 to the L-shaped operating bracket 46 which, in turn, is connected by the lug 47 to the locking latch 26, while the corresponding end of the cable jacket 40 is held stationary by the fitting 42 and the nut 43, the movement of the cable core 41 relative to the cable jacket 40 will result in pivoting of the locking latch 26 toward the unlocking position on actuation of the lock in the unlocking direction, and toward the locking position on actuation of the lock in the locking direction. Once the key is removed from the lock, the latter cannot be actuated without the key. During the movement of the locking latch 26 toward the locking position, the locking portion 49 will penetrate into the space bounded by the hasp 15 and the engagement surface 50 of the locking portion will engage the hasp 15 and slide along the same until the locking position of the locking latch 26 is reached. On movement of the locking latch 26 toward its unlocking position, the engagement surface 50 will remain juxtaposed with the hasp 15 until shortly before reaching the unlocking position.

Should the cable core 41 develop a slack, or should it be too long relative to the cable jacket 40 to begin with, it is possible to make an adjustment, for instance, by rotating the fitting in the threaded bore of the mounting bracket 33 so as to make the effective length of the cable jacket 40 longer by the requisite amount. However, should this be insufficient, or should the fitting 42 merely pass through the mounting bracket 33 with play, that is, without meshing with any thread, it is possible to attend to the required adjustment by loosening the nut 35 and changing the position of the mounting bracket 33.

It will be understood that each of the elements described above, or two or more together, may also find a useful application in other types of arrangements differing from the type discussed above.

While the invention has been illustrated and described as embodied in an add-on locking mechanism for passenger car hoods, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A combination, comprising:

(a) a factory-installed primary motor vehicle hood locking arrangement including (i) wall means on a vehicle hood and forming an opening thereon, (ii) a support member stationarily mounted on a vehicle body in the vicinity of said hood opening, and (iii) a cable-released locking catch having a substantially hook-shaped catch portion mounted on the support member for pivoting movement between a hood-closed position in which the hook-shaped catch portion is received in said hood opening and engages the wall means forming the same, and a hood-released position in which the hook-shaped portion is removed from said hood opening; and (b) an add-on auxiliary locking mechanism accessory including (i) a locking latch having a substantially hook-shaped latch portion, (ii) means for mounting said locking latch adjacent the locking catch on the support member for movement between a locking position in which said hook-shaped latch portion is simultaneously received in said same hood opening in which the hook-shaped catch portion is received in said hood-closed position and in which said hook-shaped latch portion engages the wall means forming said same hood opening to thereby prevent opening of the hood regardless of the position of the locking catch, and an unlocking position in which said hook-shaped latch portion is removed from said hood opening to thereby permit opening of the hood in said hood-released position of the hook-shaped catch portion, and (iii) means for moving said locking latch independently of the movement of the locking catch, said moving means including a connecting cable connected to said locking latch for moving the latter between its locking and unlocking positions.

2. The combination as defined in claim 1, the hook-shaped catch portion is mounted on the support member for pivoting movement in one generally vertical plane, and wherein said hook-shaped latch portion is operatively mounted on the support member for pivoting movement in another generally vertical plane which is offset from said one plane.

3. The combination as defined in claim 2, wherein said mounting means mounts said hook-shaped latch portion in a substantially parallel, close, side-by-side relationship with the hook-shaped catch portion to permit both to be received in said same hood opening.

4. The combination as defined in claim 1, wherein said wall means includes a generally U-shaped hasp which bounds said hood opening.

5. The combination as defined in claim 1, wherein said mounting means includes a mounting plate on which said locking latch is mouted, said mounting plate being threadedly connected to the support member.

6. The combination as defined in claim 5, wherein said mounting means includes a cable mounting bracket and means for securing the same to said mounting plate for positional adjustment, including an elongated slot in said mounting bracket, at least one threaded element extending through said slot and movable therealong to any desired position, and a complementary threaded tightenable element which threadedly meshes with said element and which frictionally engages said mounting bracket around said slot to hold said mounting bracket in fixed position relative to said mounting plate upon tightening.

7. The combination as defined in claim 6, wherein said mounting bracket has a guide portion which is received for guided movement in said slot during said positional adjustment.

8. The combination as defined in claim 6, wherein said connecting cable includes a tubular jacket and a core received in said jacket for axial movement therein, and wherein said moving means includes means for connecting said jacket to said mounting bracket in said position.

9. The combination as defined in claim 8, wherein said moving means includes an operating bracket operatively connected to said locking latch, and means for connecting said core to said operating bracket.

10. The combination as defined in claim 1, wherein said locking latch has a mounting portion of one piece with said latch portion, said mounting portion being pivotably mounted on the support member.

11. The combination as defined in claim 1, wherein said latch portion has a curved engagement surface facing toward and centered on an axis of pivoting movement of said latch portion so as to engage the wall means forming said hood opening while said latch portion is in its locking position and while it pivots between said locking and unlocking positions thereof.

12. The combination as defined in claim 1, wherein said add-on auxiliary locking mechanism accessory is readily and detachably mounted on the factory-installed primary motor vehicle hood locking arrangement.

13. The combination as defined in claim 1, wherein said connecting cable is a Bowden cable.

14. A combination, comprising:

(a) a factory-installed primary motor vehicle hood locking arrangement including (i) a generally U-shaped hasp secured to a vehicle hood and bounding a hasp opening therewith, (ii) a support member stationarily mounted on a vehicle body in the vicinity of said hasp opening, and (iii) a cable-released locking catch having a substantially hook-shaped catch portion mounted on the support member for pivoting movement in one generally vertical plane between a hood-closed position in which the hook-shaped catch portion is received in said hasp opening and engages the hasp, and a hood-released position in which the hook-shaped catch portion is removed from said hasp opening; and (b) an add-on auxiliary locking mechanism accessory including (i) a locking latch having a mounting portion and a substantially hook-shaped latch portion of one piece therewith, (ii) means for readily and detachably mounting said locking latch adjacent the locking catch in a side-by-side relationship therewith on the support member for pivoting movement in another generally vertical plane offset from said one plane between a locking position in which said hook-shaped latch portion is simultaneously received in said same hasp opening in which the hook-shaped catch portion is received in said hood-closed position and in which said hook-shaped latch portion engages the hasp to thereby prevent opening of the hood regardless of the position of the locking catch, and an unlocking position in which said hook-shaped latch portion is removed from said hasp opening to thereby permit opening of the hood in said hood-released position of the hook-shaped catch portion, and (iii) means for moving said locking latch independently of the movement of the locking catch, said moving means including a connecting cable connected to said locking latch for moving the latter between its locking and unlocking positions.

15. An add-on auxiliary locking mechanism accessory for use in conjunction with a factory-installed primary motor vehicle hood locking arrangement of the type having wall means on the hood and forming an opening thereon, a support member stationarily mounted on the vehicle body in the vicinity of said hood opening, and a cable-released locking catch having a substantially hook-shaped catch portion mounted on the support member for pivoting movement between a hood-closed position in which the hook-shaped catch portion is received in said hood opening and engages the wall means forming the same, and a hood-released position in which the hook-shaped catch portion is removed from said hood opening, said accessory comprising:

(a) a locking latch having a substantially hook-shaped latch portion;

(b) means for mounting said locking latch adjacent the locking catch on the support member for movement between a locking position in which said hook-shaped latch portion is simultaneously received in said same hood opening in which the hook-shaped catch portion is received in said hood-closed position and in which said hook-shaped latch portion engages the wall means forming said same hood opening to thereby prevent opening of the hood regardless of the position of the locking catch, and an unlocking position in which said hook-shaped latch portion is removed from said hood opening to thereby permit opening of the hood in said hood-released position of the hook-shaped catch portion, said mounting means including a mounting plate on which said locking latch is mounted, said mounting plate being threadedly connected to the support member, said mounting means further including a cable mounting bracket and means for securing the same to said mounting plate for positional adjustment, said securing means having an elongated slot in said mounting bracket, at least one threaded element extending through said slot and movable therealong to any desired position, and a complementary threaded tightenable element which threadedly meshes with said element and which frictionally engages said mounting bracket around said slot to hold said mounting bracket in fixed position relative to said mounting plate upon tightening, said mounting bracket having a guide portion which is received for guided movement in said slot during said positional adjustment; and (c) means for moving said locking latch independently of the movement of the locking catch, said moving means including a connecting cable connected to said locking latch for moving the latter between its locking and unlocking positions.

* * * * *